United States Patent [19]

Nagai

[11] Patent Number: 5,064,363

[45] Date of Patent: Nov. 12, 1991

[54] NON-LUBRICATED SCREW MACHINE WITH A ROTOR HAVING A TAPER AND VARIED HELICAL ANGLE

[75] Inventor: Toshiaki Nagai, Shimizu, Japan

[73] Assignee: Hitachi, Ltd., Tokyo, Japan

[21] Appl. No.: 493,482

[22] Filed: Mar. 14, 1990

Related U.S. Application Data

[62] Division of Ser. No. 330,476, Mar. 30, 1989, Pat. No. 4,952,125.

[30] Foreign Application Priority Data

Apr. 6, 1988 [JP] Japan ..... 63-82962

[51] Int. Cl.[5] ..... F04C 18/16

[52] U.S. Cl. ..... 418/194; 418/201.3

[58] Field of Search ..... 418/83, 194, 201.1, 418/201.3; 417/366

[56] References Cited

U.S. PATENT DOCUMENTS

| | | | |
|---|---|---|---|
| 3,179,330 | 4/1965 | MacColl | 418/201.1 |
| 3,807,911 | 4/1974 | Caffrey | 418/201.1 |
| 4,475,878 | 10/1984 | Kasuya et al. | 418/201.3 |
| 4,529,363 | 7/1985 | Suzuki | 418/83 |
| 4,695,233 | 9/1987 | Miyoshi et al. | 418/83 |

*Primary Examiner*—Richard A. Bertsch
*Assistant Examiner*—David L. Cavanaugh
*Attorney, Agent, or Firm*—Antonelli, Terry, Stout & Kraus

[57] ABSTRACT

A nonlubricated screw fluid machine comprising a pair of rotors including a male and a female screw rotors provided with a dual lead tooth profile on the basis of the difference in the temperature between the outlet side and the inlet side when forming a tapered rotors considering the temperature distribution within the rotors in which each of the shape of the male and female rotors after the thermal expansion is employed as a basic tooth profile.

5 Claims, 7 Drawing Sheets

NON-LUBRICATED SCREW MACHINE WITH A ROTOR HAVING A TAPER AND VARIED HELICAL ANGLE

This is a division of application Ser. No. 330,476, filed Mar. 30, 1989, now U.S. Pat. No. 4,952,125, issued Aug. 28, 1990.

BACKGROUND OF THE INVENTION

The present invention relates to, a nonlubricated screw fluid machine in which engaging male and female rotors are rotatably mounted in a casing thereof with no lubricating oil being supplied within the casing and, more particularly, to a screw fluid machine including a rotor with a tooth profile that is preferably used in a nonlubricated screw compressor or a nonlubricated screw vacuum pump.

A conventional type of nonlubricated screw fluid machine provides air containing no oil component since no oil is supplied during the rotation of a pair of engaging rotors. Such nonlubricated screw fluid machines are, therefore, widely used in various fields related to semiconductor manufacturing, the food industry and biotechnology.

In the nonlubricated screw fluid machine of the type described above, engaging male and female rotors are rotatably disposed in a casing with the engagement between the rotors being such that small gaps being formed therebetween by virtue of a synchronizing device provided on the rotor shaft portion disposed outside the casing. In these machines, in order to prevent any deterioration in sealing performance due to the presence of the small gaps between the rotors, the rotational speed of the rotors must be several times that of oil cooling type rotors.

As a result, the temperature of the rotors is raised to several hundred degrees during the operation, and thermal expansion also becomes greater with respect to the shape of the rotor at room temperature when the rotors are stopped. It is, therefore, necessary that the two rotors rotate so as not to interfere with each other in view of the thermal expansion of the two rotors. In particular, since the inlet side of the rotor and the outlet side thereof are different in temperature distribution and thermal expansion, the diameter of the outlet (discharging) side of the rotor in the direction of the shaft of the rotor is conventionally smaller, while the diameter of the inlet (suction) side is larger so that no mutual interference takes place by virtue of the thus-realized tapered shape. This is accomplished by, for example, machining or a corrosion method.

An arrangement of the aforementioned type is disclosed, for example, in Japanese Patent Unexamined Publication No. 59-208077.

Since the above-tapered rotors are formed conventionally with an inclination corresponding to the difference in the radius of tooth-bottom thereof on the basis of the difference between the inlet side and the outlet side in the temperature distribution, the width of each bottom portion becomes larger at the outlet side than at the inlet side after the machining has been completed.

As a result, the rotors may interfere with each other at their bottom portions when the nonlubricated screw fluid machine is operated, causing a problem of possible interference between the rotors.

SUMMARY OF THE INVENTION

An object of the present invention is to provide a nonlubricated screw fluid machine designed for the purpose of improving the efficiency by preventing interference of the two rotors on the basis of the difference between the inlet side and the outlet side of the rotors in the temperature distribution.

The nonlubricated screw fluid machine according to the present invention is characterized in that a dual lead tooth profile is provided for at least one of the male rotor or the female rotor on the basis of the difference in temperature between the outlet side and inlet side when the shape of the rotors is tapered considering the temperature distribution within the rotor on the basis of the thermal-expanded shape of both male and female rotors.

Figure 1:
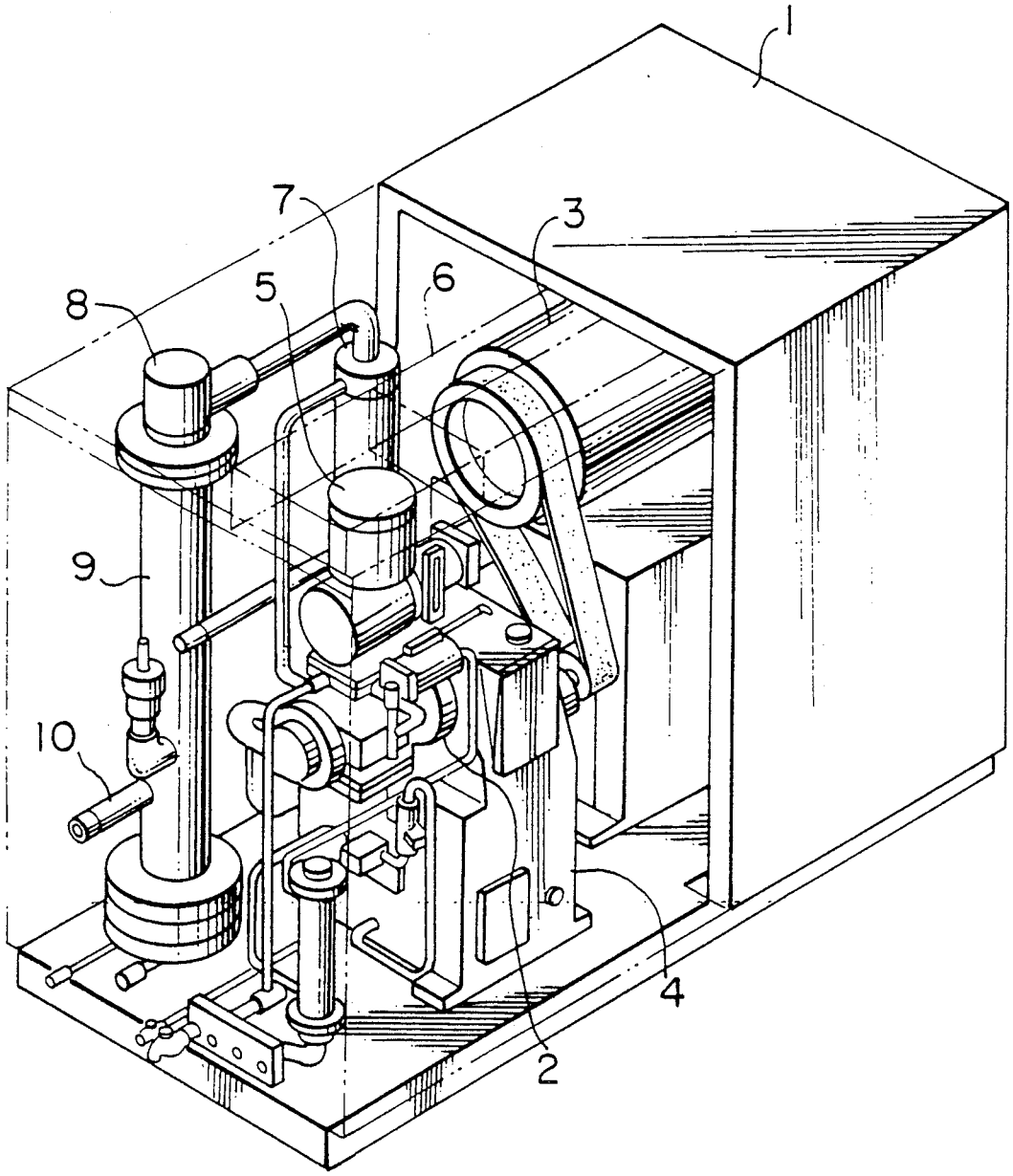
FIG. 1 is schematic perspective view of an embodiment of a nonlubricated screw fluid machine according to the present invention.

Referring now to the drawings wherein like reference numerals are used throughout the various views to designate like parts and, more particularly, to FIG. 1, according to this figure, a single stepped non-lubricated screw compressor capable of taking in atmospheric air and compressing the same includes a sound proof cover 1, accommodating a main compressor 2, a motor 3 for driving the main compressor 2, a speed increaser 4 disposed between the main compressor 2 and the motor 3, a suction filter 5 and an intake duct 6 disposed at the side of the inlet port mounted in the main compressor 2, an air discharging precooler 7 disposed at the side of the outlet port mounted in the main compressor 2, a stopper valve 8 and an aftercooler 9.

Suctioned atmospheric air which is introduced into the main compressor 2 via the intake duct 6 and the suction filter 5, wherein the pressure of air is raised up to a predetermined level. Then, the compressed air is discharged through an outlet port 10 via the air discharging precooler 7, the stopper valve 8 and the aftercooler 9 after it has been cooled down to a predetermined temperature.

Figure 2:
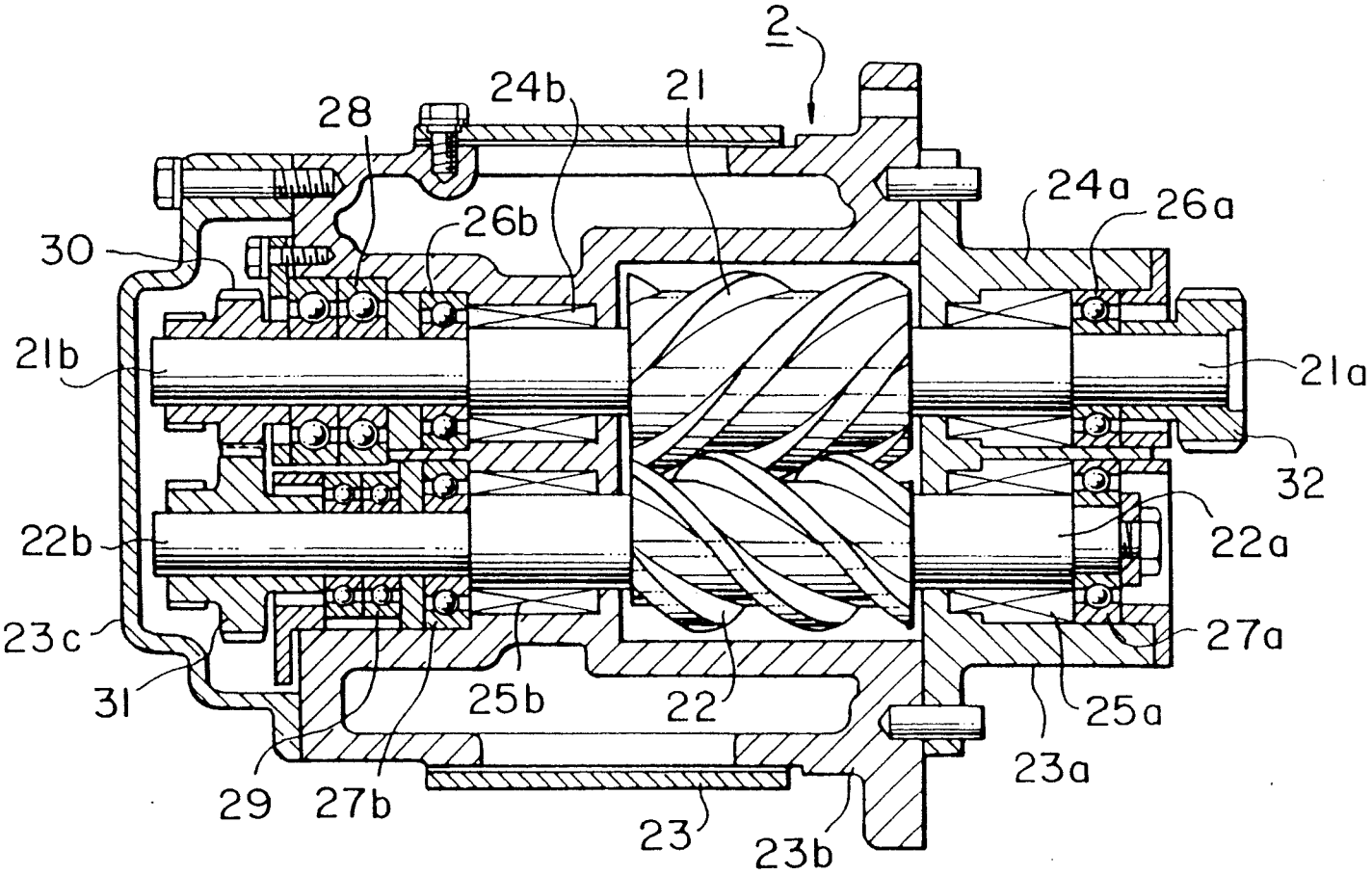
FIG. 2 is a vertical cross-sectional, view of an example of the screw fluid machine of a main compressor body of FIG. 1.

As shown most clearly in FIG. 2, the main compressor 2 includes a male rotor 21 and a female rotor 22 in engagement with each other, and a casing 23 surrounding the male rotor 21 and the female rotor 22. The casing 23 includes an inlet casing **23*a*, outlet casing 23*b*, and an end cover 23*c*, with the outlet casing 23*b* accommodating the two rotors 21 and 22. Intake side rotor shafts 21*a* of the male rotor 21 and 22*a* of the female rotor 22 are inserted into a shaft seal devices 24*a* and 25*a* disposed in the portion of the inlet casing 23*a* disposed at the end portion of the intake side through which the shafts of the compressor penetrate. These shaft seal devices 24*a* and 25*a* seal up compression gas and waste oil from a bearing. Furthermore, the radial load of the two rotors 21 and 22 is borne by bearings 26***a* and 27*a*.

The rotor shafts 21*b* and 22*b* respectively on the discharge side of the male rotor 21 and the female rotor 22 are inserted into shaft seal devices 24*b* and 25*b* disposed in the portion of the outlet casing 23*b* through which the shafts of the compressor penetrate. These shaft seal devices 24*b* and 25*b* seal up the compression gas and waste oil from the bearing. The radial load of the two rotors 21 and 22 is borne by bearings 26*b* and 27*b*, while the thrust load of the same is borne by bearings 28 and 29. A pair of timing gears 30 and 31 are, in state where they engage with each other, secured to end portions of to each shafts at the side of the outlet port of the male rotor 21 and the female rotor 22 so that the two rotors 21 and 22 can rotate in synchronization with each other without any contact with each other. A pinion 32 is secured to the end portion of the shaft 21*a* of the male rotor 1 at the side of the inlet port, and is rotated by a bull gear (not shown). When a rotational force from a drive power source is exerted on the pinion 32, the male rotor 21 and the female rotor 22 are rotated in a synchronized manner with a slight gap maintained by a timing gears 30 and 31. As a result, intake gas passes through the intake passage of FIG. 1, and is introduced into an intake space defined by the tooth profiles of two of the rotors 21 and 22. As a result of the rotation of two of the rotors 21 and 22, the space defined by two of the tooth profiles is gradually contracted in turn, causing the enclosed gas to be compressed. Then, the compressed gas is discharged through the outlet port 10 shown in FIG. 1.

Figure 3:
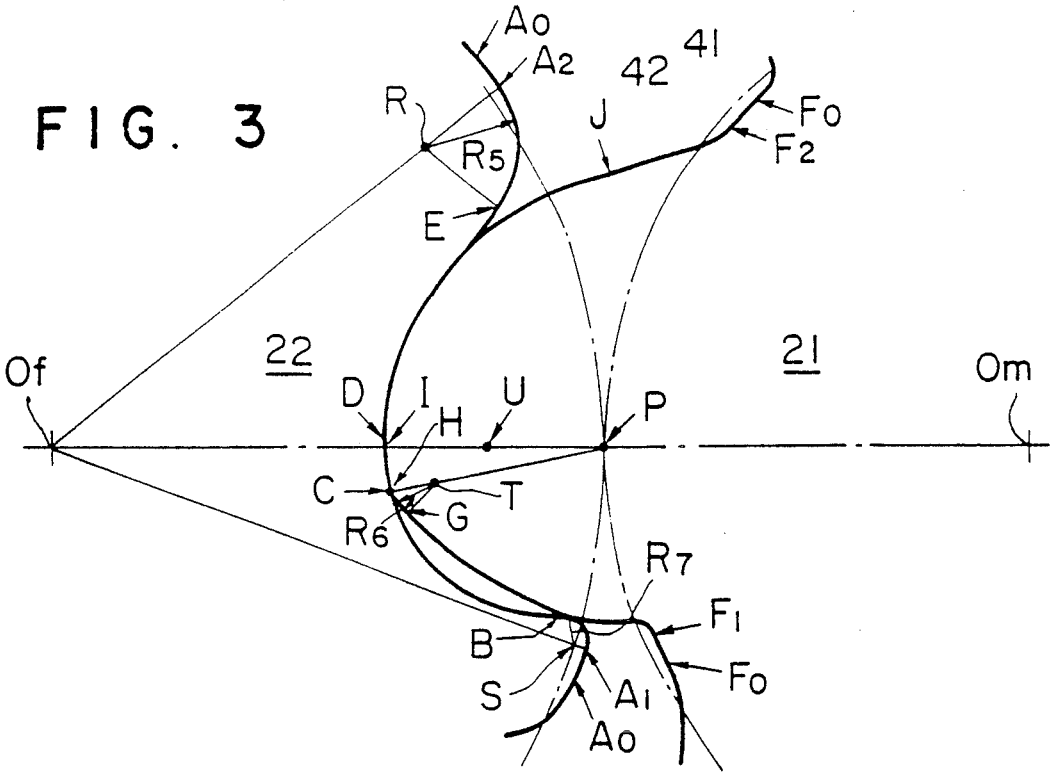
FIG. 3 is a diagrammatic view of view a basic profile of the male rotor and the female rotor of FIG. 2.

As shown in FIG. 3, each tooth-profile of the male rotor 21 and the female rotor 22 is formed by a plurality of curved lines which are divided into several sections, and the male rotor 21 and the female rotor 22 rotate relative to the center points $O_m$ and $O_f$. These center points $O_m$ and $O_f$ are positioned on an extension passing an intersection P of the pitch circles 41 and 42 of two of the rotors 21 and 22. The divided-curved lines of tooth-profile of the male and female rotors 21 and 22 are formed as follows.

First, the female rotor 22 and curved line $A_1$-B are formed to be a circular arc of radius $R_7$ centered at point S. Curved line B-C is formed by a curved line defined by a circular arc tooth profile G-H of the male rotor 21 to be described hereinafter. Curved line C-D is formed to be a circular arc whose radius is centered at the intersection P of the pitch circles 41 and 42. Curved line D-E is formed by a parabola having focus point U and focal length D-U. Curved line E-$A_2$ is formed by a circular arc having the radius centered at point R. Curved line $A_2$-$A_1$ is formed to be a circular arc centered at the center point $O_f$ of the female rotor.

Curved line $F_1$-G of tooth profile of the male rotor 21 is formed by a curved line defined by circular arc tooth profile $A_1$-B of the female rotor 22. Curved line G-H is formed by a circular arc having a radius centered at point T. Curved line H-I is formed by a circular arc having a radius centered at the intersection P of the pitch circles 41 and 42. Curved line I-J is formed by a curved line defined by a parabola tooth profile D-E of the female rotor 22. Curved line J-$F_2$ is formed by a curved line defined by circular arc tooth profile E-$A_2$ of the female rotor 22. Curved line $F_2$-$F_1$ is formed by a circular arc having a radius centered at the center point $O_m$ of the male rotor.

In the conventional nonlubricated screw compressor, the rotors need to be formed so as not to contact with each other. If they come contact with each other, a strange noise or a seizure can be generated. However, if a large gap is formed between the tooth-profiles the rotors are, deterioration of the performance is attributed the inverse flow of the compressed air or generation of leak to. Therefore, the gap needs to be as small as possible. The above-described rotor profiles are profiles in which no gap can be formed and are obtained theoretically.

The rotor is subjected to a temperature substantially 300° C. at the outlet port side of the compressor, and substantially 100° C. at the inlet port side. If the rotor is subjected to such high temperature, thermal expansion occurs in the two rotors 21 and 22, causing the interference of the two rotors.

In order to take a countermeasure against the thermal expansion, the basic tooth profile of each of the male rotor and the female rotor is determined to be the tooth profile after they have thermal-expanded, and the profile of the male rotor and the female rotor after the two rotors have been thermal-contracted are obtained.

In order to obtain the above-described profile, the contour of the two rotor are reduced by machining by a rotor work or with a rotor cutter. In this contour reduction work, manufacturing error and a backlash of the timing gears needs to be previously estimated for the purpose of obtaining the desired rotor.

As described above, in the nonlubricated screw compressor, the temperature of the rotor differs by by substantially 200° C. between the inlet side and the outlet side and, consequently the amount of thermal expansion differs between the inlet side and the outlet side. As it were, they have individual tooth profiles. However, on the viewpoint of the machining requirements, the tooth profile of the rotor at the inlet port side and that of the rotor at the outlet port side need to be tapered off by machining with the rotor inclined to form a straight line. Therefore, according to the present invention, a dual lead tooth profile is employed and have different helix angles of the forward cross-sectional shape and of the rearward cross-sectional shape.

As a result, the tooth profile of the rotors on the arbitrary cross sections is varied in the axial direction, and the rotors 21, 22 tapered with the diameter thereof increasing from the outlet side to the inlet side as shown in FIG. 2. In addition, the tooth profile of the rotors 21, 22 have no projections over the basic tooth profile on the inlet side so that the male rotor 21 and the female rotor 22 can rotate without any contact or engagement even if the outlet side and the inlet side have remarkable different temperatures.

Figure 4:
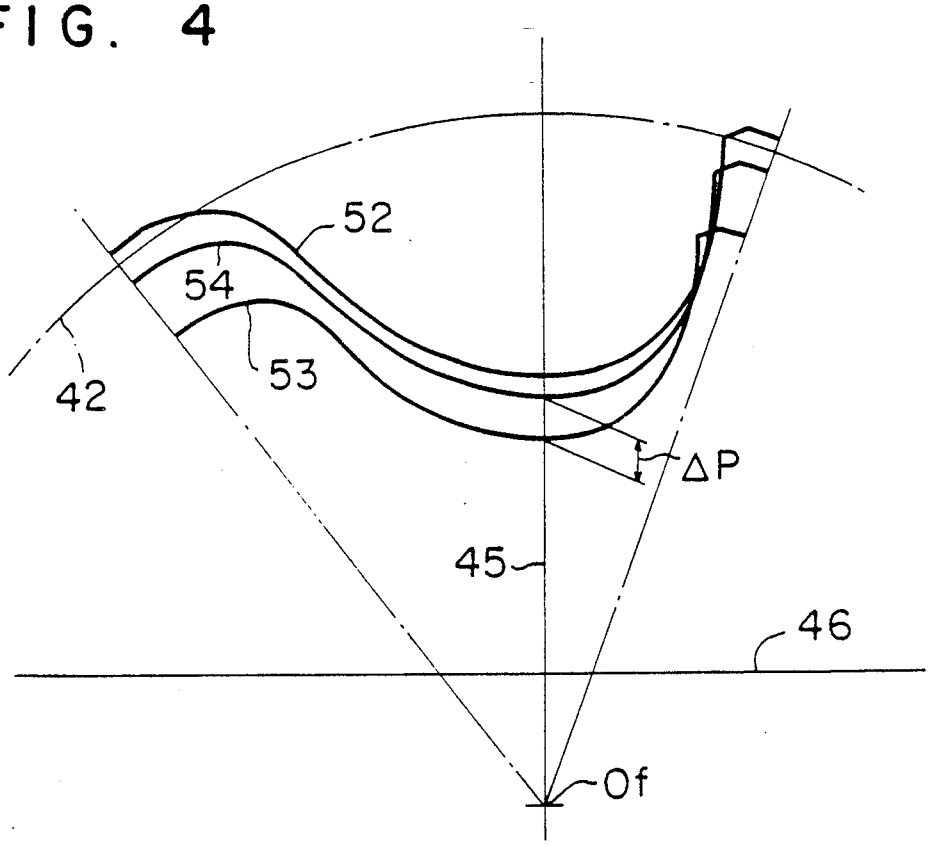
FIGS. 4 to 7 are diagrammatic views illustrating a manner to determine a dual lead for a rotor.
Figure 5:
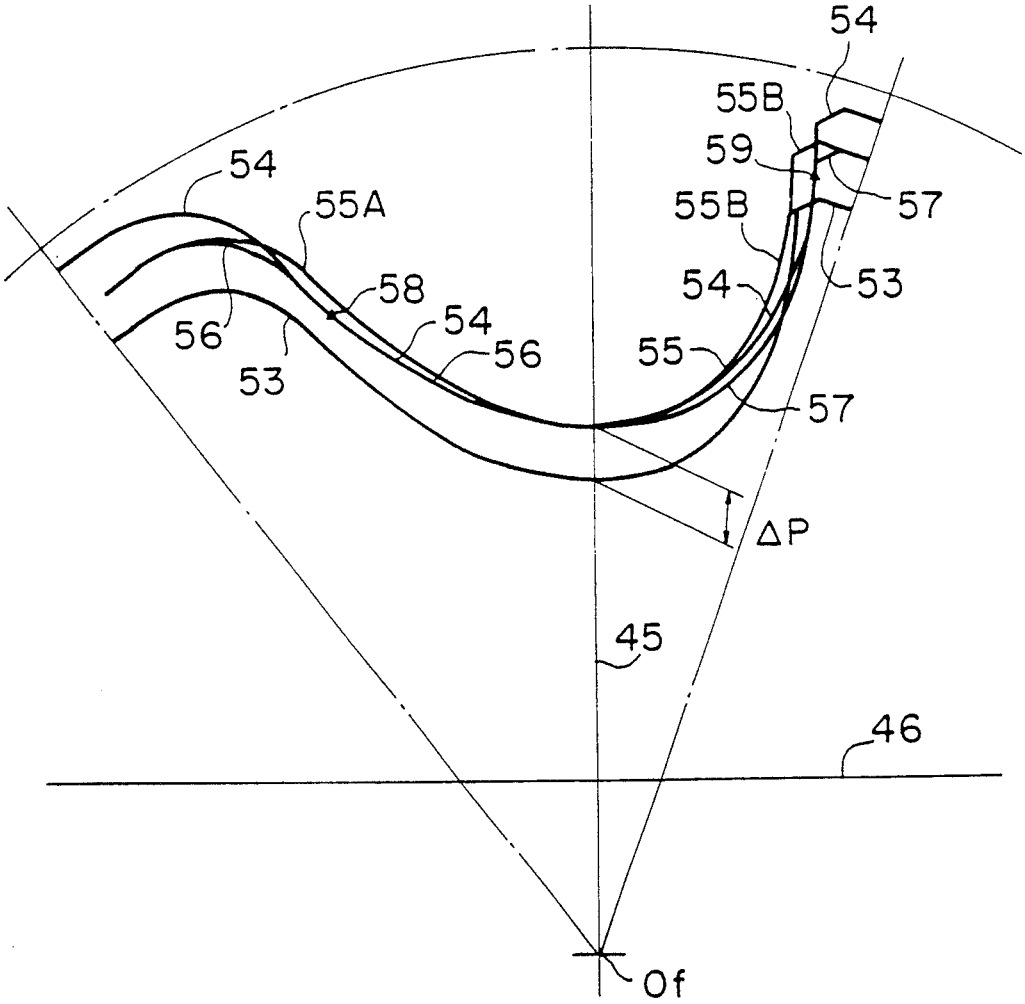

FIG. 4 illustrates a basic tooth profile 52, outlet side tooth profile 53 at room temperature and inlet side tooth profile 54, at room temperature on XOaxis 45 and Y-axis 46. When a comparison between the inlet side tooth profile 54 and outlet side tooth profile 53 with the basic tooth profile 52 is made, the temperature at the inlet side is low while the temperature at the outlet side is high. Therefore, the amount of thermal expansion at the inlet side is smaller than that at the discharge side, that is, the outlet side tooth profile 53 is needed to be formed so as to be smaller than the inlet side tooth profile 54. Therefore, if the rotor is manufactured with the outlet side tooth profile 53 twisted in the axial direction, the gap between rotors is widened to an extent corresponding to the difference $\Delta P$ between the outlet side tooth profile 53 and the inlet side tooth profile 54 on the inlet side during the operation of the compressor, causing the performance to deteriorate. In this state, it is impossible to connect all of the arbitrary points on the inlet side tooth profile 54 and the corresponding points on the outlet side tooth profile 53 with straight lines because each tooth profile of the two rotors has an individual profile and certain restrictions relating to linearity dictated by machining operations. Therefore, the most approximate shape can be realized by properly changing the tooth profile at the inlet and outlet side. Referring to FIG. 5, the manner to realize the above-described shape will be described. First, a tooth profile 55 is obtained by parallel traverse of the outlet side tooth profile 53 by ΔP along the X-axis 45. However, if the thus-parallel traversed tooth profile is employed as the tooth profile at the inlet side, a portion 55A of the forward plane (in this embodiment, identified with the left portion of the axis of ordinate 45 as shown in FIG. 5) and a portion 55B (in this embodiment, identified with the right portion of the axis of ordinate 45 as shown in FIG. 5) are brought into contact with the corresponding male rotor (not shown) since the portions 55A and 55B project further than the original portions of the inlet side tooth profile 54. Therefore, a novel tooth profile 56 is obtained by counterclockwise rotating the portion 55A of the forward plane of the outlet side tooth profile 55, which has been parallel traversed, relative to the rotor center $O_f$ until it comes contact with the original inlet side tooth profile 54. Similarly, a novel tooth profile 57 is obtained by clockwise rotating the portion 55B of the rearward plane ralative to the rotor center $O_f$ until it comes contact with the original inlet side tooth profile 54. As a result, each tooth profile having contacts 58 and 59 with the original inlet side tooth profile 54 on the forward plane and the rearward plane can be obtained. The thus-obtained tooth profile has different leads between the forward plane and the rearward plane, this difference is made in the lead corresponding to the clockwise or counterclockwise rotation of the tooth profile on the forward plane side and the rearward plane side. Thus the inlet side tooth profile of the female rotor 22 with a dual lead is obtained.

Next, the corresponding points on the outlet side tooth profile 53 and the points on the inlet side tooth profile 54 obtained by transversing the outlet side tooth profile 53 are connected with straight lines.

The thus-obtained tooth profile becomes tapered by the degree corresponding to the above-described difference ΔP at the tooth bottom, and the tooth profile has the different leads with respect to the axis of ordinate 45 of the rotor between the forward side and the rearward side.

The machining for obtaining such tooth profile on the female rotor 22 can be performed by installing the material for the female rotor 22 with this material inclined with respect to the axis of the working machine by the degree corresponding to the above-described difference ΔP, and machining each tooth profile at the forward plane and the same at the rearward plane by using, for example, a tooth cutter.

A manner to determine the dual lead to be provided for the male rotor will be performed similarly to the manner for obtaining the tooth profile for the female rotor.

Then, the manner to determine the dual lead of the male rotor will be described with reference to FIGS. 6 and 7.

Figure 6:
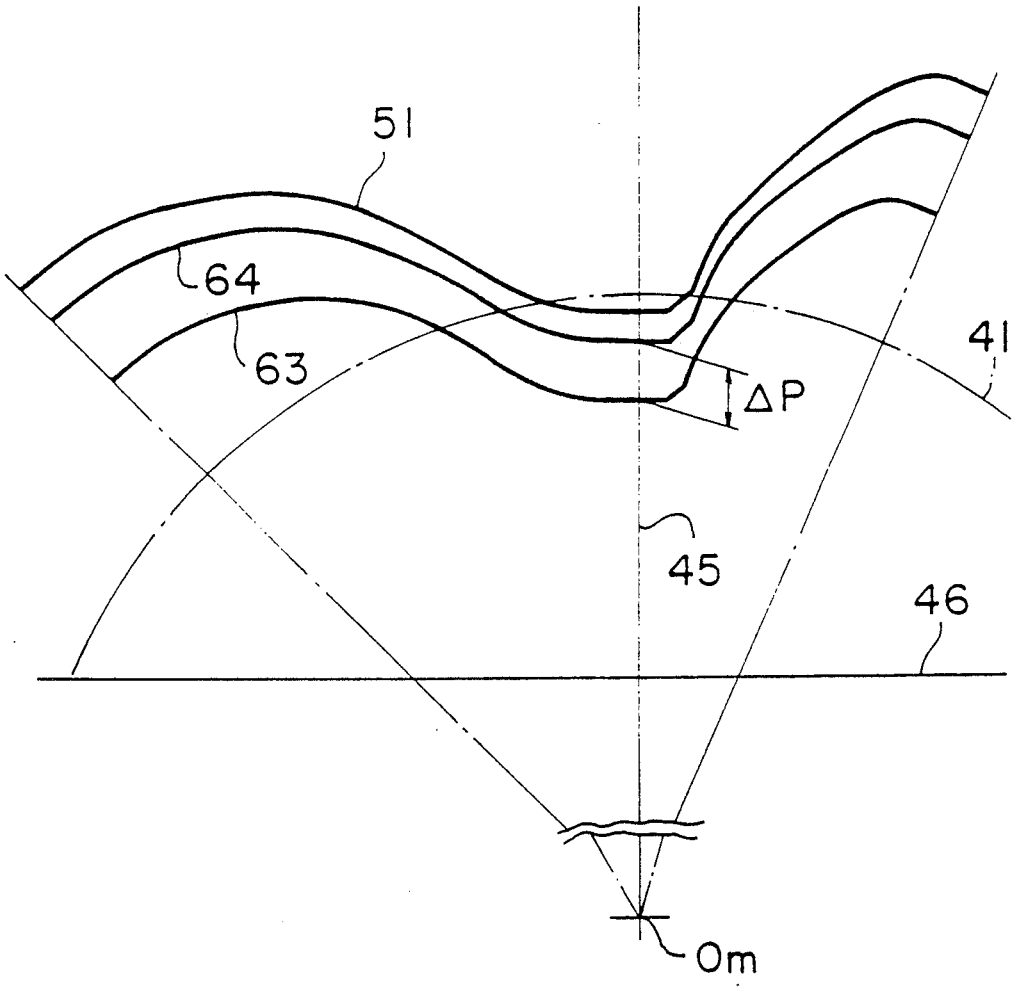

FIG. 6 illustrates the basic tooth profile 51, an outlet side tooth profile 63 at room temperature, and inlet side tooth profile 64 at room temperature on the X-axis 45 and Y-axis 46. In this case, the tooth bottom of the male rotor is needed to be positioned on the axis of ordinate 45 in FIG. 6.

Referring to FIG. 6, ΔP represents the difference along the axis of ordinates between the outlet side tooth profile 63 and the inlet side tooth profile 64.

Figure 7:
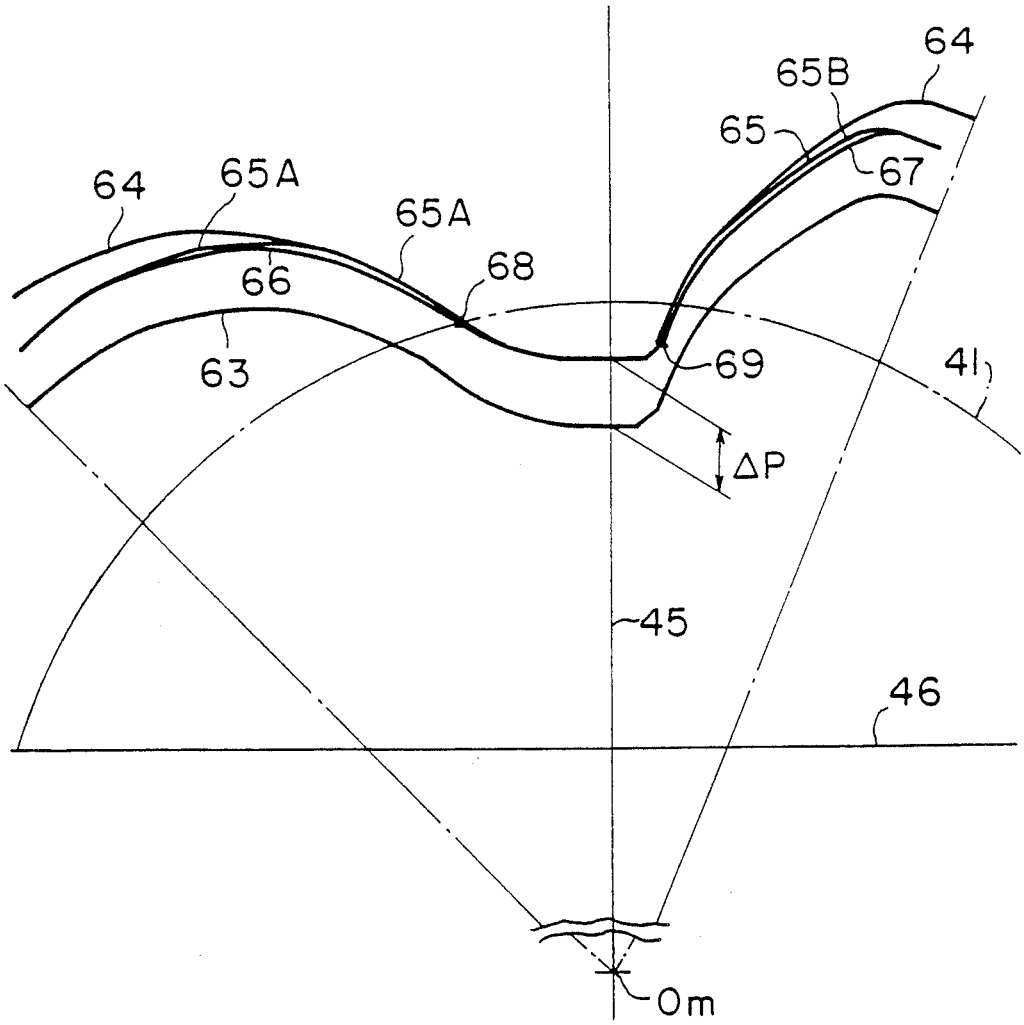

Referring to FIG. 7, a manner to determine the dual lead for the rotor will be described.

First, the outlet side tooth profile 63 is parallel transversed along the axis of ordinate 45 by ΔP so that a tooth profile 65 is obtained.

However, if the thus-parallel transversed tooth profile 65 is employed as the tooth profile at the inlet side, a portion 65A of the forward plane (in this embodiment, identified with the left portion of the axis of ordinate 45 as shown in FIG. 7) and a portion 65B (in this embodiment identified with, the right portion of the axis of ordinate 45 as shown in FIG. 7) are brought into contact with the corresponding female rotor (not shown) since the portions 65A and 65B project further than the original portions of the inlet side tooth profile 64. Therefore, a novel tooth profile 66 is obtained by counterclockwise rotating the portion 65A of the forward plane of the outlet side tooth profile 55, which has been parallel transversed, relative to the rotor center $O_m$ until it comes contact with the original inlet side tooth profile 64.

Similarly, a novel tooth profile 67 is obtained by clockwise rotating the portion 65B of the rearward plane relative to the rotor center $O_m$ until it comes contact with the original inlet side tooth profile 64.

As a result, each tooth profile having a contacts 68 and 69 with the original inlet side tooth profile 64 on the forward plane and the rearward plane can be obtained. The thus-obtained tooth profile has different leads between the forward plane and the rearward plane, the difference is made in lead corresponding to the clockwise or counterclockwise rotation of the tooth profile on the forward plane side and the rearward plane side. Thus, the inlet side tooth profile of the female rotor by employing a dual lead is obtained.

The male rotor is manufactured in a similar machining manner to that for manufacturing the female rotor.

As described above, even if the inlet and outlet sides of the male rotor 21 and the female rotor 22 have remarkable different temperatures, the rotors 21, 22 which can rotate without contact can be manufactured.

Although the dual lead is respectively provided for both the forward and rearward planes of the male and female rotor 21, 22, the provision of the dual lead for either of the male rotor 21 or the female rotor 22 can, of course, improve the performance.

Then, the gap perpendicular to the axis of the tooth profile for the male rotor 21 and that of the tooth profile of the female rotor 22 according to the present invention and those according to the conventional tooth profile of the male rotor and the tooth profile of the female rotor will be described with reference to FIGS. 8 to 10.

Referring to these figures, the axis of abscissas illustrate contact points F0, F1, G, H, I, J and F2 which represent the points on the male rotor 21 of FIG. 3, while A0, A1, B, C, D, E, and A2 represent the points on the female rotor 22 of FIG. 3. For example, the point expressed by Fl Al or B B represents a fact that the point Fl or point G of the male rotor 21 comes contact and engages with the point A1 or point B of the female rotor 22 when the rotor is rotated.

The gap should be read along the axis of ordinate, in which the negative values represents a fact that the rotors come contact with each other.

The characteristic curve represents the gap between the surfaces of the male rotor 21 and the female rotor 22 during the operation. The temperature during the operation of the rotors is 300° C. at the outlet side, and is 100° C. at the inlet side. A characteristic curve S designated by a continuous line represents a gap perpendicular to the axis at the inlet side of the rotor, a characteristic curve D designated by a continuous line represents a gap perpendicular tó the axis at the outlet side of the rotor, and a characteristic curve M designated by a dashed line represents a gap perpendicular to the axis at the intermediate portion.

Figure 8:
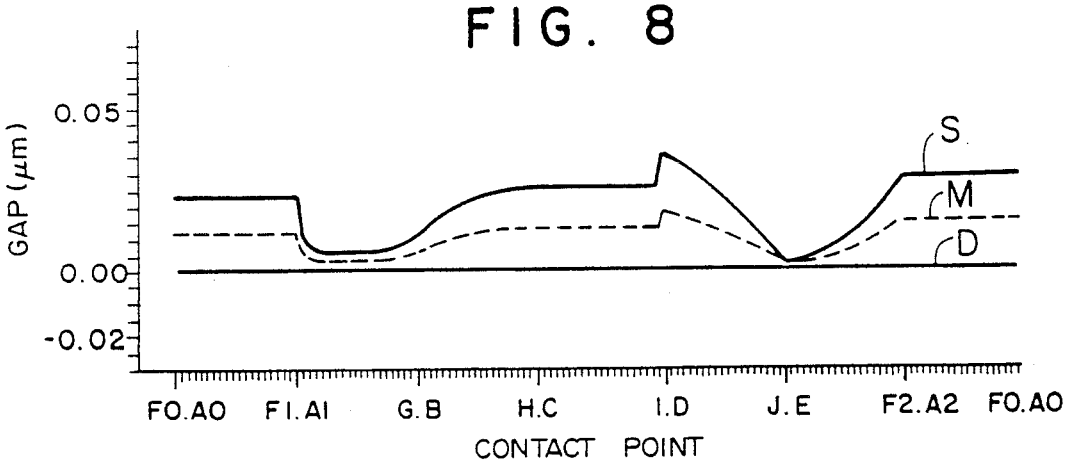
FIGS. 8 to 10 are graphical illustrations of relationships between the length of gap in the direction perpendicular to the shaft between rotors according to the present invention and conventional example.
Figure 9:
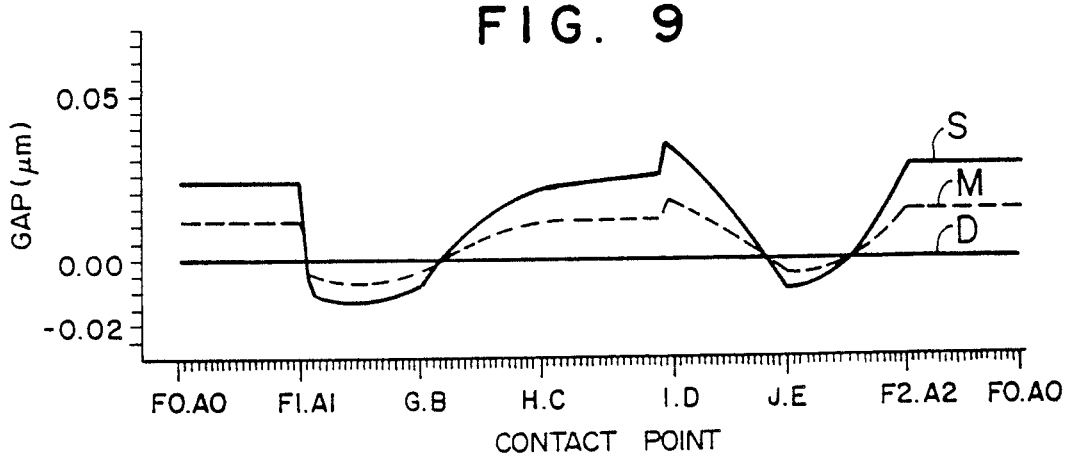

FIG. 8 illustrates a relationship in which the dual lead is provided to all of the forward and rearward planes of the male rotor 21 and the forward and rearward planes of the female rotor 22. FIG. 9 illustrates another relationship in which no dual lead is provided to both the male rotor 21 and the female rotor 22, that is, their inlet side tooth profile is formed by parallel traversing to an extent corresponding to the above-described difference ΔP. FIG. 10 illustrates yet another relationship in which the dual lead is provided to both the forward and rearward planes of the female rotor 22, while the dual lead is provided for only the forward plane of the male rotor 21. As can be clearly seen from these figures, the provision of the dual lead can prevents the gap of the negative value, that is, the male rotor 21 and the female rotor 22 are prevented from the contact with each other.

On the other hand, if no lead is provided, the gap of the negative value occurs in some places during the rotation of the rotors, that is, the male rotor and the female rotor comes contact with each other and engage with each other.

Figure 10:
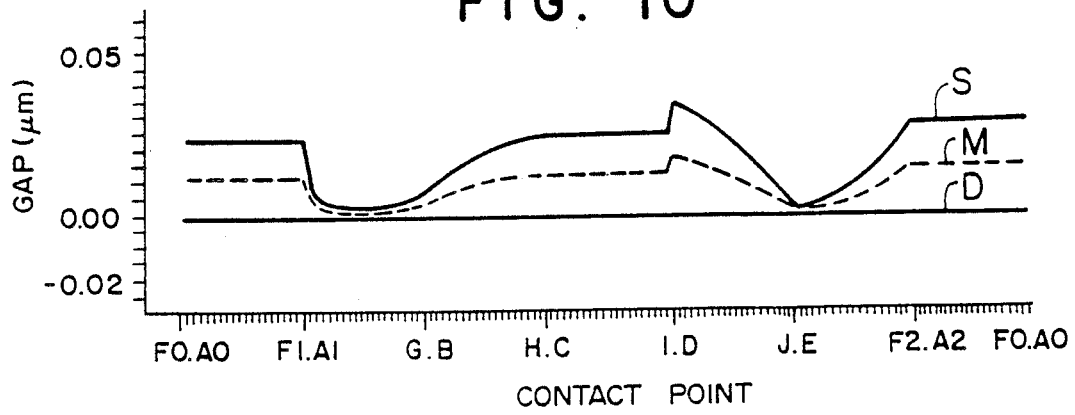

As shown in FIG. 10, provision of this dual lead for either of the male rotor 21 or the female rotor 22 can cause a satisfactorily effect. If the dual lead is provided either of the forward plane or the rearward plane of the male rotor 21, the similar effect and advantage can be obtained by provision of the dual lead either the rearward plane or the forward plane of the female rotor 22.

What is claimed is:

1. A nonlubricated screw fluid machine comprising:

a main compressor body including a casing means comprising an inlet port and an outlet port;

a male screw rotor and a female screw rotor engageably disposed in said casing means;

drive source means for rotating said male screw rotor and said female screw rotor;

precooler means disposed at an outlet port side of said said main compressor body for precooling a gas to be discharged;

after cooler means disposed downstream of the precooler means for cooling gas discharged from an outlet of said precooler means; and stopper valve means disposed between said precooler means and said after cooler means for preventing an inverse flow of said gas;

wherein said male screw rotor and said female screw rotor each have a smaller diameter at said outlet port side than a diameter at an inlet port side of said main compressor body; and wherein at least one of said male screw rotor and said female screw rotor is provided with a tooth profile having different helix angles between a forward plane of one of the rotors and a corresponding rearward plane of the other of said rotors.

2. A nonlubricated screw fluid machine according to claim 1, wherein said male screw rotor has an outlet side tooth profile and an inlet side tooth profile, said outlet side tooth profile and said inlet side tooth profile corresponding to a rotor tooth profile when said male and female rotors are thermally expanded, said inlet side tooth profile is formed by an outwardly parallel traverse of said outlet side tooth profile in a radial direction of said male rotor by an amount corresponding to a difference between said outlet side tooth profile and said inlet side tooth profile determined by at least one of a counterclockwise rotating of a portion at a forward plane of a tooth profile formed by said parallel traverse relative to a center of the male screw rotor until said portion at the forward plane contacts the inlet side tooth profile at room temperature, and by clockwise rotating a portion at a rearward plane of a tooth profile formed by said parallel traverse until said portion at the rearward plane contacts with said inlet side tooth profile at room temperature relative to the center of said male rotor whereby said male rotor is provided with the tooth profile having different helix angles.

3. A nonlubricated screw fluid machine according to claim 1, wherein said female screw rotor has an outlet side tooth profile and an inlet side tooth profile, said outlet side tooth profile and said inlet side tooth profile corresponding to a tooth profile at room temperature obtained from a rotor tooth profile when said male screw rotor and said female screw rotor are thermally expanded, said inlet side tooth profile is formed by an outward parallel traverse of said outlet side tooth profile in a radial direction of said female screw rotor by an amount corresponding to a difference between said outlet side tooth profile and said inlet side tooth profile, by a counterclockwise rotation of a portion at a forward plane of the tooth profile formed by said parallel traverse relative to a center of the female screw rotor until said portion at the forward plane contacts the inlet side tooth profile and room temperature, and by clockwise rotation of a portion at a rearward plane of a tooth profile formed by said parallel traverse until said portion at the rearward plane contacts said inlet side tooth profile at room temperature relative to the center of said female screw rotor, whereby said female screw rotor is provided with the different helix angles.

4. A male screw rotor for a non-lubricated screw fluid machine, the male screw rotor comprising an outlet side tooth profile and an inlet side tooth profile, said outlet side tooth profile and said inlet side tooth profile corresponding to a rotor tooth profile when said male and female rotors are thermally expanded, said inlet side tooth profile is formed by an outwardly parallel traverse of said outlet side tooth profile in a radial direction of said male rotor by an amount corresponding to a difference between said outlet side tooth profile and said inlet side tooth profile determined by at least one of a counterclockwise rotating of a portion at a forward plane of a tooth profile formed by said parallel traverse relative to a center of the male screw rotor until said portion at the forward plane contacts the inlet side tooth profile at room temperature, and by clockwise rotating a portion at a rearward plane of a tooth profile formed by said parallel traverse until said portion at the rearward plane contacts with said inlet side tooth profile at room temperature relative to the center of said male rotor whereby said male rotor is provided with the tooth profile having different helix angles.

5. A female screw rotor for a non-lubricated screw fluid machine, the female screw rotor comprising an outlet side tooth profile and an inlet side tooth profile, said outlet side tooth profile and said inlet side tooth profile corresponding to a tooth profile at room temperature obtained from a rotor tooth profile when said male screw rotor and said female screw rotor are thermally expanded, said inlet side tooth profile is formed by an outward parallel traverse of said outlet side tooth profile in a radial direction of said female screw rotor by an amount corresponding to a difference between said outlet side tooth profile and said inlet side tooth profile, by a counterclockwise rotation of a portion at a forward plane of the tooth profile formed by said parallel traverse relative to a center of the female screw rotor until said portion at the forward plane contacts the inlet side tooth profile and room temperature, and by clockwise rotation of a portion at a rearward plane of a tooth profile formed by said parallel traverse until said portion at the rearward plane contacts said inlet side tooth profile at room temperature relative to the center of said female screw rotor, whereby said female screw rotor is provided with the different helix angles.

* * * * *